US006446374B1

(12) United States Patent
Ardiff

(10) Patent No.: US 6,446,374 B1
(45) Date of Patent: Sep. 10, 2002

(54) EMERGENCY IDENTIFICATION CARD DEVICE

(76) Inventor: William J. Ardiff, 16021 Redington Dr., Redington Beach, FL (US) 33708

( * ) Notice: Subject to any disclaimer, the term of this patent is extended or adjusted under 35 U.S.C. 154(b) by 35 days.

(21) Appl. No.: 09/671,894

(22) Filed: Sep. 28, 2000

(51) Int. Cl.[7] ..... G09F 21/04

(52) U.S. Cl. ..... 40/593; 40/591; 40/643; 40/644; 40/661.08

(58) Field of Search ..... 40/643, 644, 649, 40/654.01, 661, 661.08, 661.09, 591, 593

(56) References Cited

U.S. PATENT DOCUMENTS

| | | | | | |
|---|---|---|---|---|---|
| 1,488,152 | A | * | 3/1924 | Harley | 40/593 |
| 2,788,041 | A | * | 4/1957 | Carver | 150/147 |
| 2,925,675 | A | * | 2/1960 | Lumpkin | 40/643 |
| 3,533,178 | A | * | 10/1970 | Strohmaier | 40/643 |
| 3,792,542 | A | | 2/1974 | Cohan | |
| 3,958,690 | A | | 5/1976 | Gee, Sr. | |
| 4,055,012 | A | * | 10/1977 | Cote | 40/611 |
| 4,156,539 | A | | 5/1979 | Davidson et al. | |
| 4,236,332 | A | | 12/1980 | Domo | |
| D260,153 | S | | 8/1981 | Koltys | |
| 4,632,428 | A | * | 12/1986 | Bown | 283/76 |
| 4,864,755 | A | * | 9/1989 | Owens | 40/661 |
| 4,896,027 | A | * | 1/1990 | Drexler | 40/626 |
| 4,955,153 | A | * | 9/1990 | Albrecht et al. | 40/593 |
| 5,112,016 | A | | 5/1992 | Pull | |
| D342,180 | S | * | 12/1993 | Kirlin | D6/567 |
| 5,502,912 | A | * | 4/1996 | LeBoff et al. | 40/593 |
| 5,566,980 | A | | 10/1996 | Fizer | |
| 5,658,016 | A | | 8/1997 | Goeken | |
| 5,771,619 | A | * | 6/1998 | Wells | 40/643 |
| 6,086,707 | A | * | 7/2000 | Waller | 40/661 |
| 6,089,608 | A | * | 7/2000 | Exline | 281/21.1 |

OTHER PUBLICATIONS

Copy of newspaper advertisement from the "St. Petersburg Times" describing the "Personal Medical Data Card". Dated Feb. 26, 2002. p. 7G.

* cited by examiner

*Primary Examiner*—Lynne H. Browne
*Assistant Examiner*—James M Hewitt

(57) ABSTRACT

An emergency identification card device for quickly identify and notify next of kin when the user is involved in an accident. The emergency identification card device includes a card member having a front side and a back side and being foldable in half with the card member also having written information displayed thereon with the written information including medical information of a user and phone numbers of people to notify in case of an accident all being displayed upon the front side thereof; and also includes a card holder assembly including a transparent card holder having side walls and being adapted to securely attach to a windshield of a vehicle and also being adapted to hold the card member therein.

7 Claims, 2 Drawing Sheets

EMERGENCY IDENTIFICATION CARD DEVICE

BACKGROUND OF THE INVENTION

1. Field of the Invention

The present invention relates to an in-case-of-an-emergency identification card and more particularly pertains to a new emergency identification card device to quickly identify and notify next of kin when the user is involved in an accident.

2. Description of the Prior Art

The use of an in-case-of-an-emergency identification card is known in the prior art. More specifically, an in-case-of-an-emergency identification card heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,958,690; 4,236,332; 5,658,016; 3,792,542; 4,156,539; 5,566,980; U.S. Pat. No. Des. 260,153; and U.S. Pat. No. 5,112,016.

While these devices fulfill their respective, particular objectives and requirements, the aforementioned patents do not disclose a new emergency identification card device. The inventive device includes a card member having a front side and a back side and being foldable in half with the card member also having written information displayed thereon with the written information including medical information of a user and phone numbers of people to notify in case of an accident all being displayed upon the front side thereof; and also includes a card holder assembly including a transparent card holder having side walls and being adapted to securely attach to a windshield of a vehicle and also being adapted to hold the card member therein.

In these respects, the emergency identification card device according to the present invention substantially departs from the conventional concepts and designs of the prior art, and in so doing provides an apparatus primarily developed for the purpose of quickly identify and notify next of kin when the user is involved in an accident.

SUMMARY OF THE INVENTION

In view of the foregoing disadvantages inherent in the known types of in-case-of-an-emergency identification card now present in the prior art, the present invention provides a new emergency identification card device construction wherein the same can be utilized for quickly identify and notify next of kin when the user is involved in an accident.

The general purpose of the present invention, which will be described subsequently in greater detail, is to provide a new emergency identification card device which has many of the advantages of the in-case-of-an-emergency identification card mentioned heretofore and many novel features that result in a new emergency identification card device which is not anticipated, rendered obvious, suggested, or even implied by any of the prior art in-case-of-an-emergency identification card, either alone or in any combination thereof.

To attain this, the present invention generally comprises a card member having a front side and a back side and being foldable in half with the card member also having written information displayed thereon with the written information including medical information of a user and phone numbers of people to notify in case of an accident all being displayed upon the front side thereof; and also includes a card holder assembly including a transparent card holder having side walls and being adapted to securely attach to a windshield of a vehicle and also being adapted to hold the card member therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new emergency identification card device which has many of the advantages of the in-case-of-an-emergency identification card mentioned heretofore and many novel features that result in a new emergency identification card device which is not anticipated, rendered obvious, suggested, or even implied by any of the prior art in-case-of-an-emergency identification card, either alone or in any combination thereof.

It is another object of the present invention to provide a new emergency identification card device which may be easily and efficiently manufactured and marketed.

It is a further object of the present invention to provide a new emergency identification card device which is of a durable and reliable construction.

An even further object of the present invention is to provide a new emergency identification card device which is susceptible of a low cost of manufacture with regard to both materials and labor, and which accordingly is then susceptible of low prices of sale to the consuming public, thereby making such emergency identification card device economically available to the buying public.

Still yet another object of the present invention is to provide a new emergency identification card device which provides in the apparatuses and methods of the prior art some of the advantages thereof, while simultaneously overcoming some of the disadvantages normally associated therewith.

Still another object of the present invention is to provide a new emergency identification card device for quickly identify and notify next of kin when the user is involved in an accident.

Yet another object of the present invention is to provide a new emergency identification card device which includes a card member having a front side and a back side and being foldable in half with the card member also having written information displayed thereon with the written information including medical information of a user and phone numbers of people to notify in case of an accident all being displayed upon the front side thereof; and also includes a card holder assembly including a transparent card holder having side walls and being adapted to securely attach to a windshield of a vehicle and also being adapted to hold the card member therein.

Still yet another object of the present invention is to provide a new emergency identification card device that is conveniently located inside the passenger compartment of a vehicle.

Even still another object of the present invention is to provide a new emergency identification card device that eliminates the long delays in locating and notifying next of kin when the user is involved in a serious vehicle accident.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
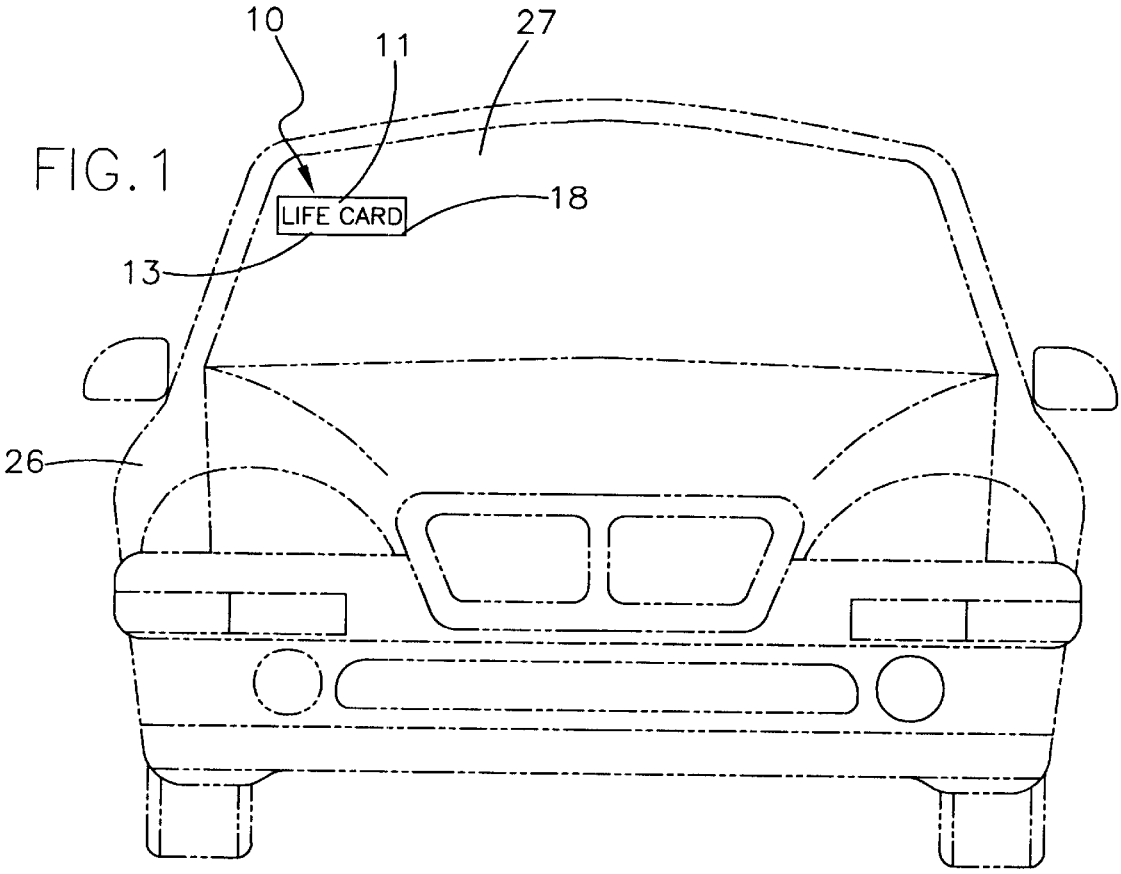
FIG. 1 is a front elevational view of a new emergency identification card device according to the present invention shown in use being attached to the windshield of a vehicle.
Figure 2:
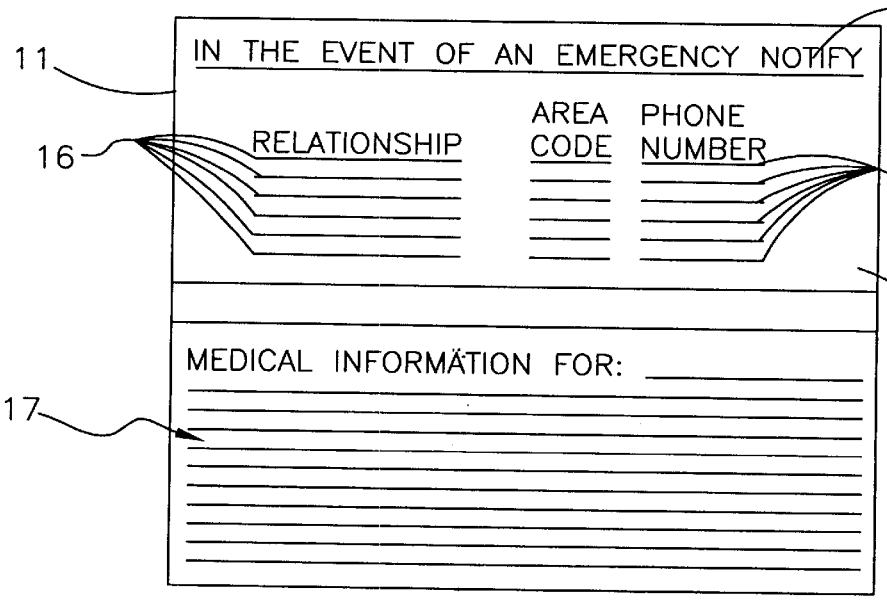
FIG. 2 is a front elevational view of front side of the card member of the present invention.
Figure 3:
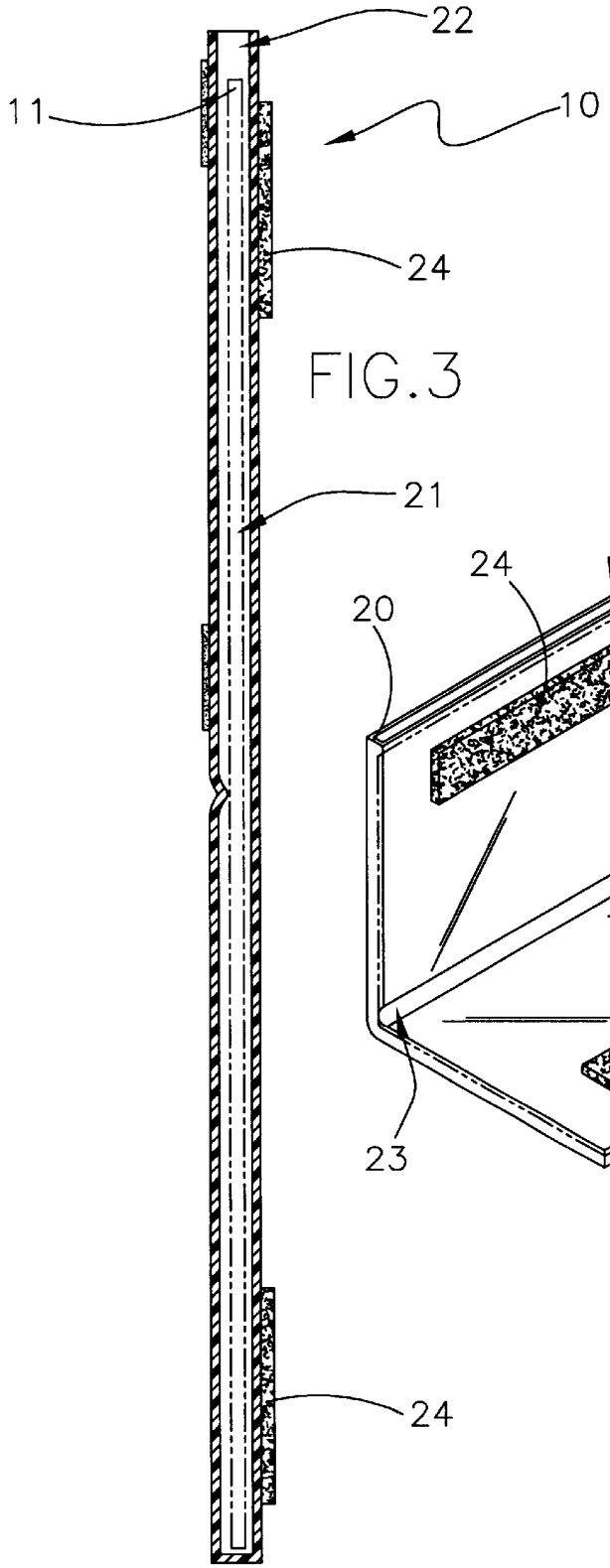
FIG. 3 is an edge elevational view of the transparent card holder of the present invention.
Figure 4:
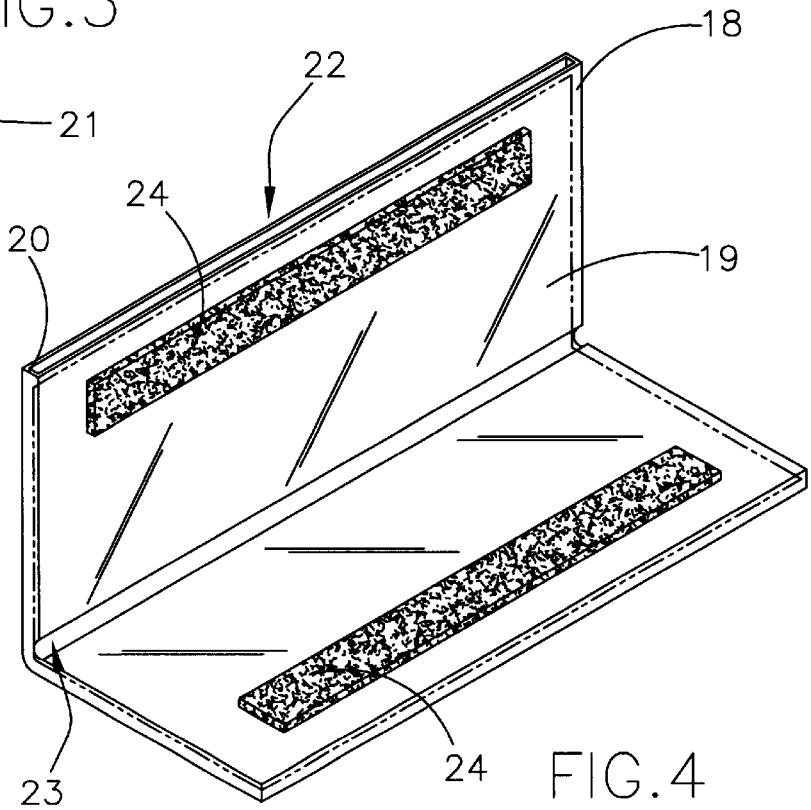
FIG. 4 is a perspective view of the card holder assembly of the present invention.

With reference now to the drawings, and in particular to FIGS. 1 through 4 thereof, a new emergency identification card device embodying the principles and concepts of the present invention and generally designated by the reference numeral 10 will be described.

As best illustrated in FIGS. 1 through 4, the emergency identification card device 10 generally comprises a card member 11 having a front side 12 and a back side 13 and being foldable in half with the card member 11 also having written information 14 displayed thereon. The written information 14 includes medical information 17 of a user and phone numbers 15 of people to notify in case of an accident all being displayed upon the front side 12 thereof. The written information 14 further includes words "LIFE CARD" being displayed in bold letters upon the back side 13 of the card member 11 with the bold letters being fluorescent in either red or orange colors and being visible at night in darkness. The card member 11 is foldable upon the front side 12 thereof to keep confidential the written information 14 displayed on the front side 12. The written information 14 also identifies only the relationship 16 of the people associated with the phone numbers 15 displayed upon the card member 11 with the card member 11 being foldable to approximately 3 inches by 5 inches.

A card holder assembly includes a transparent card holder 18 having front 19 and back 20 walls and being adapted to securely attach to a windshield 27 of a vehicle 26 and also being adapted to hold the card member 11 therein. The transparent card holder 18 includes a pleat 23 centrally disposed in and extending along a length of one of the walls 19, 20, and also includes a compartment 21 disposed inside thereof and being adapted to receive the card member 11, and further includes an opening 22 disposed through a side edge thereof and into the compartment 21. The opening 22 is adapted to receive the card member 11 therethrough with the card holder assembly also including strips of adhesive 24 securely and conventionally disposed upon one of the walls 19, 20 of the transparent card holder 18 for securely attaching the transparent card holder 18 to an upper right hand corner of the windshield 27 of the vehicle 26. The transparent card holder 18 has a thickness substantially smaller than either the length or width thereof with the transparent card holder 18 being substantially thin and being made of vinyl.

In use, the transparent card holder 18 and card member 11 would be retrieved by the rescue workers following a car accident by the user, and would give the information 14–17 to the appropriate authorities; whereupon, the authorities would use the information 14–17 not only to contact the next of kin of the user but also to treat the user for injuries sustained in the car accident.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An emergency identification card device for securing to a windshield of a vehicle comprising:

a card member having a front side and a back side and being foldable in half, said card member also having written information displayed thereon, said written information including medical information of a user and phone numbers of people to notify in case of an accident all being displayed upon said front side;

a card holder assembly for removably holding said card member therein, said card holder assembly including a transparent card holder having front and back walls;

wherein said card member is foldable along a fold line in said front side thereof for concealing said written information displayed on said front side, and wherein said transparent card holder includes a pleat extending along a length of one of said walls for positioning adjacent to said fold line in said card member such that said card holder is foldable between an open position and a closed position;

a first pair of strips of adhesive disposed upon one of said walls of said transparent card holder for attaching said transparent card holder to an upper right hand corner of a windshield of a vehicle, said first pair of strips being located on one portion of said card holder bounded by said pleat and a portion of a perimeter of said card holder for permitting securing of said card holder to the windshield in said closed position or in said open position; and securing means for securing said card holder in said closed position, said securing means being located on said card holder on the wall opposite the said wall having said first pair of strips thereon.

2. An emergency identification card device as described in claim 1, wherein said written information further includes words "LIFE CARD" being displayed in bold letters upon said back side of said card member, said bold letters being fluorescent with bright colors and visible at night in darkness.

3. An emergency identification card device as described in claim 1, wherein said transparent card holder includes a compartment disposed inside thereof and being adapted to receive said card member, and further includes an opening disposed through a side edge thereof into said compartment, said opening being adapted to receive said card member therethrough.

4. An emergency identification card device as described in claim 1, wherein said transparent card holder has a thickness substantially smaller than either said length or width thereof, said transparent card holder being substantially thin and being made of vinyl.

5. An emergency identification card device as described in claim 1, wherein said written information identifies only the relationship of the people associated with said phone numbers displayed upon said card member.

6. An emergency identification card device as described in claim 1, wherein said securing means comprises a pair of adhesive strips.

7. An emergency identification card device for securing to a windshield of a vehicle comprising:

a card member having a front side and a back side and being foldable in half, said card member also having written information displayed thereon, said written information including medical information of a user and phone numbers of people to notify in case of an accident all being displayed upon said front side;

a card holder assembly for removably holding said card member therein, said card holder assembly including a transparent card holder having front and back walls;

wherein said card member is foldable along a fold line in said front side thereof for concealing said written information displayed on said front side, and wherein said transparent card holder includes a pleat extending along a length of one of said walls for positioning adjacent to said fold line in said card member such that said card holder is foldable between an open position and a closed position;

a first pair of strips of adhesive disposed upon one of said walls of said transparent card holder for attaching said transparent card holder to an upper right hand corner of a windshield of a vehicle, said first pair of strips being located on one portion of said card holder bounded by said pleat and a portion of a perimeter of said card holder for permitting securing of said card holder to the windshield in said closed position or in said open position; and securing means for securing said card holder in said closed position, said securing means being located on said card holder on the wall opposite the said wall having said first pair of strips thereon, wherein said securing means comprises a pair of adhesive strips;

wherein said written information further includes words "LIFE CARD" being displayed in bold letters upon said back side of said card member, said bold letters being fluorescent with bright colors and visible at night in darkness;

wherein said transparent card holder includes a compartment disposed inside thereof and being adapted to receive said card member, and further includes an opening disposed through a side edge thereof into said compartment, said opening being adapted to receive said card member therethrough;

wherein said transparent card holder has a thickness substantially smaller than either said length or width thereof, said transparent card holder being substantially thin and being made of vinyl;

wherein said written information identifies only the relationship of the people associated with said phone numbers displayed upon said card member.

* * * * *